United States Patent [19]

Schafer

[11] Patent Number: 5,035,647

[45] Date of Patent: Jul. 30, 1991

[54] DEVICE FOR SECURING A RECEPTACLE HOUSING IN AN OPENING OF A WALL

[75] Inventor: Helmut Schafer, Kreuztal-Fellinghausen, Fed. Rep. of Germany

[73] Assignee: Rittal-Werk Rudolf Loh GmbH & Co. KG, Fed. Rep. of Germany

[21] Appl. No.: 432,682

[22] Filed: Nov. 7, 1989

[30] Foreign Application Priority Data

Nov. 7, 1988 [DE] Fed. Rep. of Germany ... 8813917[U]

[51] Int. Cl.[5] ..... H01R 13/627

[52] U.S. Cl. ..... 439/557; 439/135

[58] Field of Search ..... 439/135, 554, 555, 557, 439/559, 562, 567

[56] References Cited

U.S. PATENT DOCUMENTS 3,519,977 7/1970 Swearingen ..... 439/135

3,523,269 8/1970 Witek et al. ..... 439/557 X

FOREIGN PATENT DOCUMENTS 2742653 3/1979 Fed. Rep. of Germany ..... 439/135

*Primary Examiner*—Eugene F. Desmond

*Attorney, Agent, or Firm*—Thomas W. Speckman; Douglas H. Pauley

[57] ABSTRACT

The invention relates to a device for securing a receptacle housing, positioned at the end of a cable, in an opening of a wall. The receptacle housing and the opening have a generally rectangular cross-sectional area and can be connected with each other in at least two positions, offset by 90° from each other. The receptacle housing has detent springs which engage with the wall, from behind. A securing strap is fixed on the cable which is connected to the receptacle housing. The other end of the securing strap is connected to a cover. The cover can be mounted on the contact side of the receptacle housing. The cover can be guided through a groove-shaped recess while the securing strap is pushed through a side wall of the opening. The alignment between receptacle and opening, without impairment of the passage of the securing strap, is achieved in that the opening of the wall only has recesses for the securing strap of the cover in two side walls, located at right angles to each other. The two side walls determine a vertical and a horizontal routing of the cable to the receptacle housing.

8 Claims, 2 Drawing Sheets

DEVICE FOR SECURING A RECEPTACLE HOUSING IN AN OPENING OF A WALL

BACKGROUND OF THE INVENTION

1. Field of the Invention

The invention relates to a device for securing a receptacle housing attached to the end of a cable, in an opening of a wall. The receptacle housing and the opening have a generally rectangular cross-sectional area and can be connected with each other in at least two positions offset by 90° from each other. The receptacle housing has detent springs on two opposite sides of the exterior. The detent springs engage and grip the wall from behind. A securing strap is fixed on the cable and connected with the receptacle housing and on another end to a cover. The cover may be mounted on the contact side of the receptacle housing and is disposed in a groove-shaped recess for passing the securing strap being disposed in a side wall of the opening.

2. Description of the Prior Art

It is known in the art that a cover can be secured behind a wall by a securing strap, so that when it is not in use, for example when the plug has been removed, the contact side of the receptacle can be covered and protected. In the known receptacles, the cable is inserted into the receptacle housing by a lateral connection and the securing strap is held by way of a cap screw on an insertion neck of the lateral connection. Because only one side wall of the opening is provided with a recess for the securing strap, it requires that the latter be inserted on the same side of the opening, regardless of the position in which the receptacle is connected. This causes difficulties in cases where the side wall of the receptacle housing, having a connection and an insertion neck for the cable, does not coincide with the side wall of the opening having the recess for the securing strap.

This disadvantage of the prior art could be overcome by providing all side walls of the opening with recesses for the securing strap. This permits all four positions possible between the receptacle and the opening, but can lead to difficulties in the placement of the cable.

SUMMARY OF THE INVENTION

It is an object of the invention to improve a device of the type discussed above in such a way that only two defined positions are fixed for the connection between the receptacle housing and the opening of the wall, which simultaneously set a fixed vertical and a fixed horizontal routing of the cable to the receptacle housing and thus, allow the passage of the securing strap at the best suited locations of the opening.

This object is attained in accordance with the invention by the opening of the wall having peripheral recesses for the securing strap of the cover only in two side walls located at right angles to each other. Such arrangement sets a precise vertical routing, for example from below as shown in FIG. 1, and a precise horizontal routing, for example from the right as shown in FIG. 1, of the cable to the receptacle housing by association of the incoming side of the cable on the receptacle housing with the side walls of the opening.

This results in the positioning of the cable, on the receptacle housing, to a side wall of the opening, on which the securing strap with the cover can also pass through. At the same time, this determines whether the cable is vertically routed to the receptacle housing from above or below, or whether it arrives at the receptacle housing horizontally from the left or right. The opening with the recesses in the side walls also determines the routing of the cable to the receptacle housing when secured in the opening.

In accordance with one embodiment of the invention, the opening has shoulders positioned in the corners which extend into the opening. The receptacle housing has protrusions in the corner areas of the receptacle housing, corresponding to the shoulders. Manipulation of the receptacle housing is made easier because the securing strap and the cover are constructed in one piece. At the end near the cable, the securing strap terminates in a support ring which is pushed on the insertion neck of the receptacle housing and is secured thereon with a threaded cap.

Flush passage of the securing strap through the wall, which is hardly noticeable, is achieved by the cross sections of the securing strap and the peripheral recesses in the side walls of the opening being rectangular.

BRIEF DESCRIPTION OF THE DRAWINGS

The invention will be described in detail in the exemplary embodiments shown in the drawings.

DETAILED DESCRIPTION OF THE PREFERRED EMBODIMENTS

Figure 1:
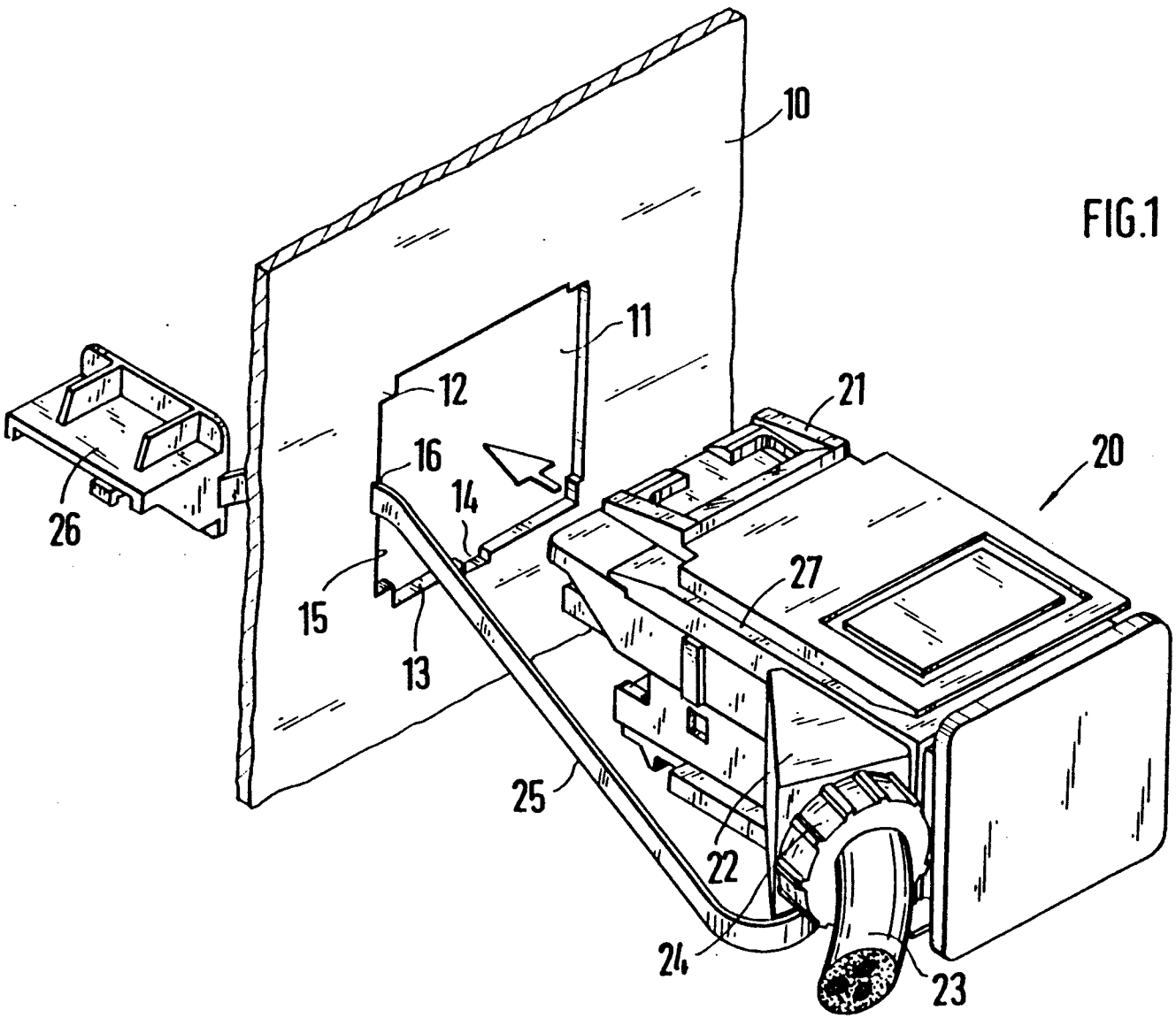
FIG. 1 is a perspective view of the receptacle housing and the opening of the wall, where the cable is routed from the left and below.

Opening 11 and receptacle housing 20 have generally rectangular cross-sectional areas. Only in the corners does opening 11 have shoulders 12 which extend into opening 11. Receptacle housing 20 has protrusions 27 along the corners of the edges of receptacle housing 20. In a preferred embodiment, wall 10 is a plate and opening 11 determines the location where receptacle housing 20 is fixed on wall 10. It is understood that the term "wall", as used in the specification and claims, means a panel, a support, a housing wall, a plate, or another similar structure.

In an embodiment in accordance with FIG. 1, recesses 14 and 16 are located in bottom wall 13 and left side wall 15 of opening 11. The cross sections of peripheral recesses 14 and 16 correspond to rectangular securing strap 25 and can receive securing strap 25 when receptacle housing 20 is secured in opening 11. For securing receptacle housing 20 in opening 11, receptacle housing 20 has detent springs 21 on two sides opposite each other, which engage and lock at the back of wall 10.

On the side which does not have detent spring 21, receptacle housing 20 has a connection 22. Connection 22 has an insertion neck for connecting cable 23. Threaded cap 24 is screwed on the insertion neck and secures cable 23 in the insertion neck. Additionally, securing strap 25 has a ring at an end, is pushed on the insertion neck and is secured on connection 22 with threaded cap 24. The other end of securing strap 25 connects to cover 26. Cover 26 is preferably made of one piece. Cover 26 is used to cover the contact side of receptacle housing 20 when it is not connected with a corresponding plug.

When receptacle housing 20 is secured in opening 11, in the position illustrated in FIG. 1, the routing of cable 23 is fixed horizontally from the left and securing strap 25 of cover 26 is passed through recess 16 of left side wall 15, of opening 11, behind wall 10. Securing strap 25 is positioned behind wall 10 from connection 22 along the shortest route and without routing detours. As indicated by recess 14 in bottom side 13 of opening 11, it is also possible to connect receptacle housing 20, after receptacle housing 20 has been rotated counterclockwise by 90°. In such position, connection 22 is directed downwardly, in the same manner with wall 10, and cable 23 is guided vertically from below to receptacle housing 20. In this embodiment, there are only two fixed positions of receptacle housing 20 on wall 10. In these two fixed positions, there is an exact and precise horizontal or vertical routing of cable 23.

Figure 2:
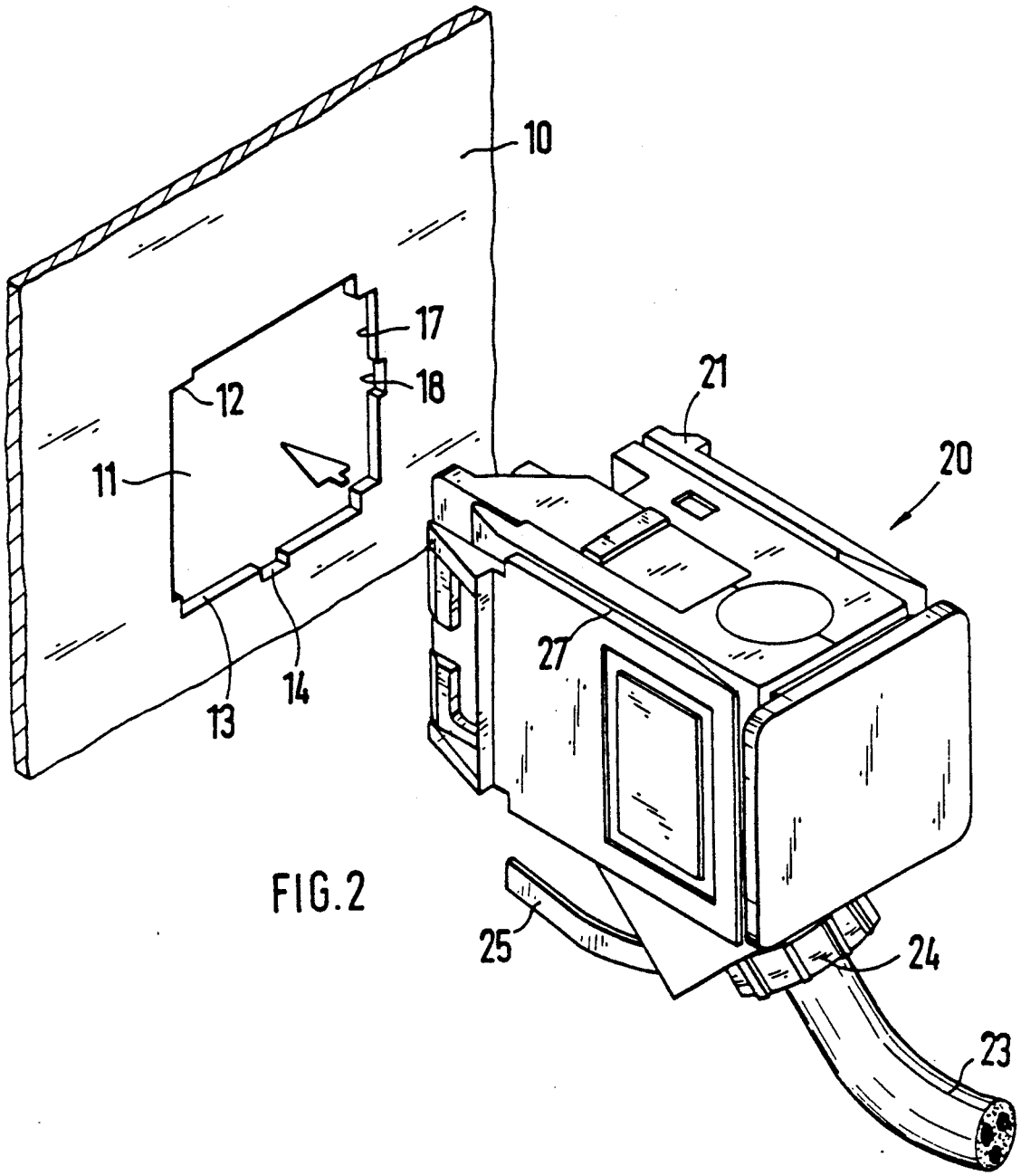
FIG. 2 is a perspective view of the receptacle housing and the opening of the wall, where the cable is routed from the right and below.

As shown by an embodiment in accordance with FIG. 2, there are only two positions for receptacle housing 20, by way of recesses 14 and 18 positioned in bottom wall 13 and right side wall 17 of opening 11. In this embodiment, only a predetermined routing of cable 23 to receptacle housing 20 is possible because only in these positions can securing strap 25 with cover 26 be guided along the shortest route through opening 11 of wall 10.

As shown in FIG. 2, receptacle housing 20 can be secured in opening 11 in such a way that securing strap 25 can be passed through recess 14, in bottom wall 13 of opening 11, behind wall 10. Cable 23 is then routed vertically from below to connection 22 of receptacle housing 20. However, receptacle housing 20 can be rotated counterclockwise by 90° and inserted into opening 11. In this embodiment, securing strap 25 is passed through recess 18 of side wall 17, behind wall 10, and cable 23 is routed horizontally from the right to receptacle housing 20.

I claim:

1. A device for securing a receptacle housing (20) positioned at an end of a Cable (23) in an opening (11) of a wall (10), the device comprising: the receptacle housing (20) and the opening (11) each having a generally rectangular cross-sectional area, the receptacle housing (20) and the opening (11) connectable in at least two positions, each of the at least two positions offset by about 90° from each other; detent springs (21) positioned on opposite sides of the receptacle housing (20), the detent springs (21) abutting the wall (10) from behind; a first end of a securing strap (25) securable to the cable (23), the cable (23) connectable with the receptacle housing (20), a second end of the securing strap (25) connectable to a cover (26); the cover (26) attachable on a contact side of the receptacle housing (20), the cover strap (25) disposable in a groove-shaped recess (14, 16 and 18), the groove-shaped recess (14, 16 and 18) located in the opening (11) for routing the securing strap (25) through the opening (11), the groove-shaped recess (14, 16 and 18) positioned in at least two side walls (13, 15 and 17) defining said opening (11); the side walls (13, 15 and 17) positioned at right angles with respect to each other, the securing strap (25) securable to the receptacle housing (20) by alignment of an incoming side of the cable (23) on the receptacle housing (20) with one of the at least two side walls (13, 15 and 17) having the groove-shaped recess (14, 16 and 18).

2. A device in accordance with claim 1, wherein the opening (11) comprises shoulders (12), the shoulders (12) are located in corners extending into the opening (11), and the receptacle housing (20) having notches (27) which correspond to the shoulders (12) of the opening (11).

3. A device in accordance with claim 1, wherein the securing strap (25) and the cover (26) are one piece, a first end of the securing strap (25) has a support ring, and the support ring is securable on an insertion neck of the receptacle housing (20) by a threaded cap (24).

4. A device in accordance with claim 1, wherein the securing strap (25) has a generally rectangular cross section and the recesses (14, 16, 18) located in the side walls (13, 15, 17) of the opening (11) are rectangular.

5. A device in accordance with claim 2, wherein the securing strap (25) and the cover (26) are one piece, a first end of the securing strap (25) has a support ring, and the support ring is securable on an insertion neck of the receptacle housing (20) by a threaded cap (24).

6. A device in accordance with claim 2, wherein the securing strap (25) has a generally rectangular cross section and the recesses (14, 16, 18) located in the side walls (13, 15, 17) of the opening (11) are rectangular.

7. A device in accordance with claim 3, wherein the securing strap (25) has a generally rectangular cross section and the recesses (14, 16, 18) located in the side walls (13, 15, 17) of the opening (11) are rectangular.

8. A device for securing a receptacle housing (20) positioned at an end of a cable, (23) in an opening (11) of a wall (10), the receptacle housing (20) and the opening (11) each having a generally rectangular cross-sectional area, the receptacle housing (20) and the opening (11) connectable in at least two positions, each of the at least two positions offset by about 90° from the other; detent springs (21) positioned on opposite sides of the receptacle housing (20), the detent springs (21) abutting the wall (10) from behind; a first end of a securing strap (25) securable to the cable (23), the cable (23) being connectable with the receptacle housing (20), a second end of the securing strap (25) connectable to a cover (26); the cover (26) attachable on a contact side of the receptacle housing (20), the strap (25) disposable in a groove-shaped recess (14, 16 and 18), the groove-shaped recess (14, 16 and 18) for routing the securing strap (25) through the opening (11), the improvement comprising: the opening (11) of the wall (10) having the groove-shaped recess (14, 16 and 18), the groove-shaped recess (14, 16 and 18) positioned in side walls (13, 15 and 17) of said opening (11), the side walls (13, 15 and 17) positioned at right angles to each other, the securing strap (25) securable to the receptacle housing (20) by alignment of an incoming side of the cable (23) on the receptacle housing (20) with one of the side walls (13, 15 and 17) having the groove-shaped recess (14, 16 and 18).

* * * * *